United States Patent [19]

Weisner et al.

[11] Patent Number: 4,860,511

[45] Date of Patent: Aug. 29, 1989

[54] STANDING SEAM ROOF SKYLIGHT SYSTEMS

[75] Inventors: Kent A. Weisner, Maitland; Lester L. Walls, Jr., Deltona, both of Fla.

[73] Assignee: Kenergy Enterprises Limited Partnership, Wausau, Wis.

[21] Appl. No.: 920,254

[22] Filed: Oct. 16, 1986

Related U.S. Application Data

[63] Continuation-in-part of Ser. No. 700,106, Feb. 11, 1985, Pat. No. 4,649,680.

[51] Int. Cl.[4] ..... E04B 7/18

[52] U.S. Cl. ..... 52/200; 52/584

[58] Field of Search ..... 52/200, 533, 72, 542, 52/51, 52, 466, 469, 537, 538, 560, 478, 584

[56] References Cited

U.S. PATENT DOCUMENTS

| | | | |
|---|---|---|---|
| 1,968,451 | 7/1934 | Hering | 52/466 |
| 4,117,638 | 10/1978 | Kidd, Jr. et al. | 52/200 |
| 4,139,974 | 2/1979 | Fox | 52/478 X |
| 4,548,006 | 10/1985 | Roberts, Sr. | 52/200 |
| 4,549,379 | 10/1985 | Hoy et al. | 52/200 |
| 4,559,753 | 12/1985 | Brueske | 52/200 X |
| 4,649,680 | 3/1987 | Weisner et al. | 52/200 |

FOREIGN PATENT DOCUMENTS

| | | | |
|---|---|---|---|
| 2856835 | 7/1980 | Fed. Rep. of Germany | 52/200 |
| 379477 | 9/1932 | United Kingdom | 52/200 |

OTHER PUBLICATIONS

Progressive Architecture Publication, p. 163, Mar. 1955.

*Primary Examiner*—Carl D. Friedman

*Attorney, Agent, or Firm*—Macdonald J. Wiggins

[57] ABSTRACT

A plastic skylight having a central dome and a pair of standing seam edges is suitable for installation in metal standing seam roofs and shingled roofs without a curb. The standing seam edges are joined to adjacent metal standing seams with the same covered by battens. The other edges of the skylight form flat flanges overlapping adjacent metal panels. When used on a shingled roof, step flashings and anchor clips are fastened to the plastic standing seams. The skylights may be clustered to form sunroofs.

10 Claims, 5 Drawing Sheets

STANDING SEAM ROOF SKYLIGHT SYSTEMS

This application is a continuation-in-part of co-pending application, Ser. No. 700,106 filed Feb. 11, 1985, now U.S. Pat. No. 4,649,680 issued on Mar. 17, 1987.

BACKGROUND OF THE INVENTION

1. Field of the Invention

The present invention relates to skylight systems for standing seam roofs, shingle roofs and sunrooms, and more particularly to standing seam skylight systems providing simple and leakproof installations thereof.

2. Description of the Prior Art

The use of skylights in residences as well as commercial buildings has become widespread in recent years with the advent of low cost and rugged plastic dome skylights. Self flashing plastic skylights are popular, partly due to economies in eliminating extensive curb construction. However, some skill is required if a leakproof installation is to be achieved and some customer dissatisfaction has occurred from poor installation practices.

Certain types of roofs have not been suitable for skylight installation. For example, it is common in the southern parts of the United States to construct patios, porches and the like using sheet metal standing seam roofing. A typical roof of this type utilizes long panels having upturned edges. The panels are laid side by side with the upstanding edge of one panel contiguous with the upstanding edge of adjacent panels. The upper edges of the upstanding portions may be bent at right angles or rolled. In either style, an interlocking bead is provided which snaps over the contiguous upstanding portions of the panels. This type of roof also is widely used for industrial buildings.

Although it is desirable in many installations to install skylights in a standing seam roof, difficulty has been experienced in adapting standard plastic dome type skylights to the standing seam metal roofs. Self flashing skylights have been used which must be screwed to the metal and require caulking compound to prevent leaking. However, due to the differing expansion coefficients of the plastic and sheet metal, it has been found very difficult to prevent leaks. Furthermore, openings must be cut into the metal which reduce the strength of the roof and add to the labor cost.

There have been attempts to overcome these problems. For example, it is known to form a narrow continuous panel of acrylic plastic or the like which will simply replace a standard metal roof panel and which runs the entire length of the roof. It is apparent that this type of unit must be narrower than a standard roof panel since the plastic lacks the required strength for a full width panel.

Problems have also arisen in installing self flashing plastic skylights in shingled roofs and care must be taken to ensure freedom from leaks. This problem is compounded when a so-called sunroof, formed by joining a plurality of plastic skylights together, is desired. A common approach to this problem is to build a "curb" which extends above the plane of the roof. The curb is a box-like structure made of wood, aluminum, fiberglass or similar material. A competent roofer can then install flashing, such as step flashings, around the curb and produce an essentially leakfree structure. The skylight is then installed on top of the curb and includes a drip mold projecting down and over the curb edge.

The disadvantage to this solution is that the curb is expensive to construct and install, requiring relatively skilled labor. It is also unsightly, since it produces the appearance of a hatch projecting from the roof plane. The curb also has the disadvantage of acting as a dam to trap water, snow, ice, leaves and other debris on the roof. On roofs with a low pitch, it is common to construct a sloping curb to increase the pitch of the skylight.

There is a need for a plastic dome type skylight which can be installed at any point along a metal roof panel without cutting an opening in the metal panel, which will not experience difficulties with leakage and which can be installed in a shingled roof with the same watertight integrity that is obtainable with curb type installations. Additionally, there is a need for a self flashed skylight which can be overlapped with others to form a leakproof sunroof.

SUMMARY OF THE INVENTION

The present invention includes a plastic skylight formed from acrylic sheet, CAB plastic sheet, polycarbonate sheet or the like having a conventional skylight dome formed therein and a self flashing flange which may be installed in a metal standing seam roof. The skylight is formed to have the same width as a standard metal roof panel. The side flanges are bent upward to the same height as the metal roofing standing seam and the end edge flanges are formed in the same manner as those of the metal roofing panels. The width of the skylight is the same as that of the metal roof panels. As may now be understood, the upstanding edges of the skylight of the invention will mate with the adjacent upstanding edges of the metal panels of the roof. A standard metal seam clip and batten are utilized and are clamped over the standing seam. Other types of upper edges such as a rolled edge can also be provided to be usable with other roof seam designs. A flange is provided at each end of the dome of the skylight which is formed to overlap the ends of metal roof panels in the same run with the skylight. The skylight flanges are formed to make a snug fit with the metal panel roof panel. The joint between the skylight and the adjacent panels in the same run may be sealed with any suitable compound. Preferably, a flat plastic sheet is bonded to a lower perimeter of the skylight dome so as to provide a dead air space for its insulation properties. in an alternative embodiment, an inverted dome may be bonded to the flat sheet thereby providing two insulating air spaces.

Some standing seam metal roofs have a flat upstanding seam. One implementation of the invention is formed by folding a flat self flashing flange of an all plastic skylight up at 90 degrees to fit against a flat seam of a metal roof panel and held together by anchor clips. A snap-on seam cap is installed over the plastic to metal seam.

The flat seam version of the invention is also suitable for installation on a shingled roof by using step flashing coupled to the upstanding seam by a seam cap and held to the roof by anchor clips. The step flashing solves the leakage problem experienced with prior art self flashing plastic skylights by placing the seam above the plane of the roof.

In another embodiment of the invention used for forming sloping sunroofs, an upstanding flat seam is provided along the sides of a plastic skylight which will mate with adjacent upstanding seams. The upper and lower ends of the skylight are formed to provide flat flanges for joining similarly formed skylights vertically aligned. A sunroof can therefore be produced by mounting a multiplicity of such skylights with the lateral standing seam edges coupled by seam caps and the flat flanges overlapped and secured to a grid of extruded metal rafters and purlins. Suitable metal seam clips and anchor clips secure the skylight edges and joints to the grid. Sealants are applied at all joints to prevent water leakage.

As will be understood, the provision of the above-disclosed plastic skylights will permit fast, accurate assembly and installation of skylights and sunroofs by relatively unskilled workers, and will provide leakproof joints with the roof.

It is therefore a principal object of the invention to provide a dome type plastic skylight which can be installed in a metal roof of the upstanding seam type.

It is another object of the invention to provide such skylights in which the upstanding seam flanges can be made to mate with a variety of types of roofs and which will provide a relatively leakproof installation by elevating lateral seams above the plane of the roof.

It is still another object of the invention to provide a skylight for use in metal upstanding seam roofs.

It is yet another object of the invention to provide a plastic self flashing skylight which can be installed on a shingled roof and coupled to the shingle portion thereof by means of step flashing without requiring a curb.

It is a further object of the invention to provide plastic skylights having upper and lower end joints that can be overlapped to form a vertical cluster of multiple skylights and laterally by standing seam edges that can be abutted to form a horizontal cluster of multiple skylights.

It is another object of the invention to provide plastic skylights that can be joined vertically and horizontally to form a sunroof.

These and other objects and advantages of the invention will become apparent from the following detailed description when read in conjunction with the drawings.

DETAILED DESCRIPTION OF THE PREFERRED EMBODIMENT

Figure 1:
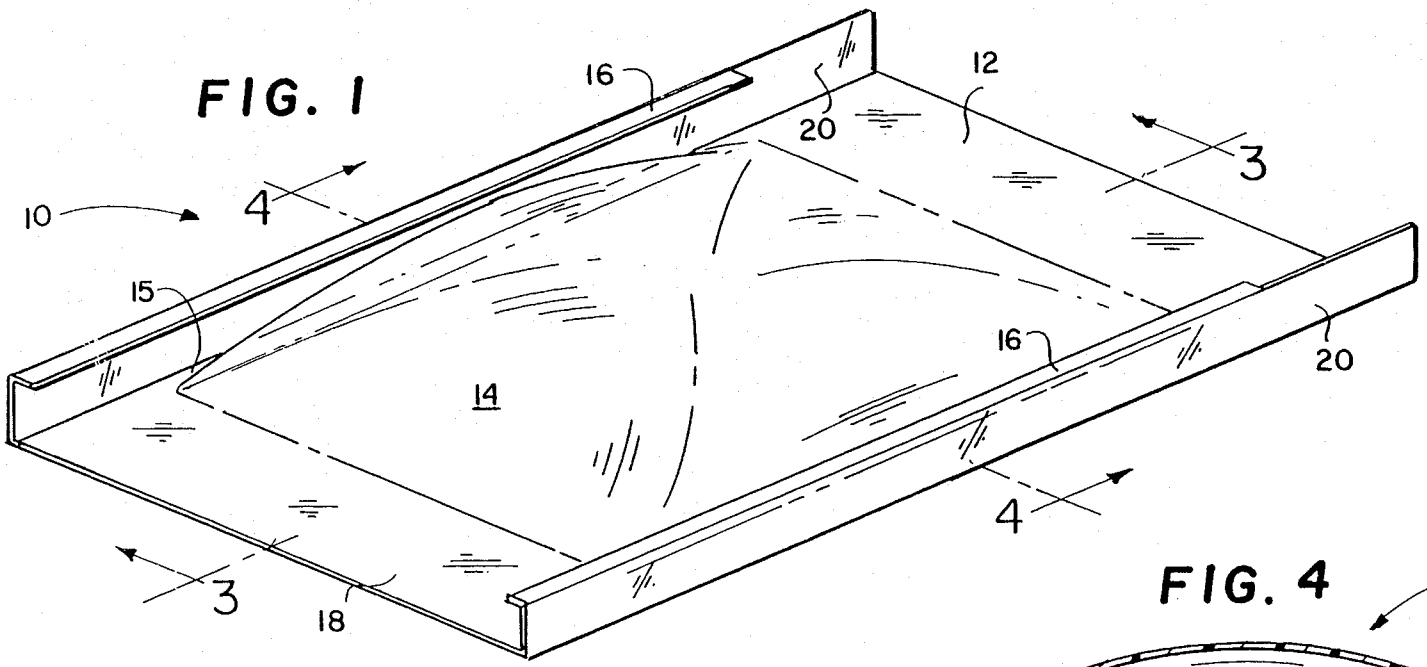
FIG. 1 is a perspective view of a typical skylight dome in accordance with the invention.

The present invention is an improved all plastic skylight design that is applicable to several types of roof structures. In one embodiment of the invention, a plastic dome type skylight is provided for use with metal standing seam roof panels. Standing seam roof panels of metal are generally found in a rectangular shape having a flat or corrugated roof section with standing seam portions bent upward at 90 degrees along each longitudinal edge. The standing seam height may be on the order of two inches. Various designs of the standing seam are available. In FIG. 1, one embodiment of the invention is shown for use with metal standing seam roof panels in which the top edge of the standing seam is bent inward at 90 degrees and a seam is formed by a batten cap disposed over the abutting standing seam. Thus, the skylight 10 shown in FIG. 1 has longitudinal-edge upstanding seams 20 with a folded-over edge 16 to match the metal standing seam roof panel with which the skylight 10 will be used. It is to be understood that other standing seam designs may also be applied to the skylight 10 to match the particular metal standing seam roof panel. This implementation of the invention will be disclosed with reference to the right angle edge 16 as shown. Plastic skylight 10 may be made of any suitable plastic sheet; however, a preferred material is polycarbonate sheet such as General Electric Lexan ®. A dome or bubble 14 may be formed in the center of the plastic sheet leaving a flat portion 18 at one end and a flat portion 12 at the opposite end. A trough area 15 is provided between seam 20 and dome 14 to insure water drainage.

Figure 4:
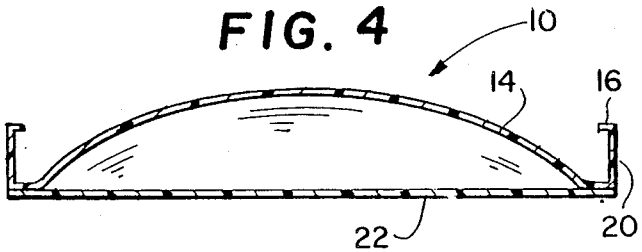
FIG. 4 is a cross-sectional view of a double skylight similar to that of FIG. 1.
Figure 3:
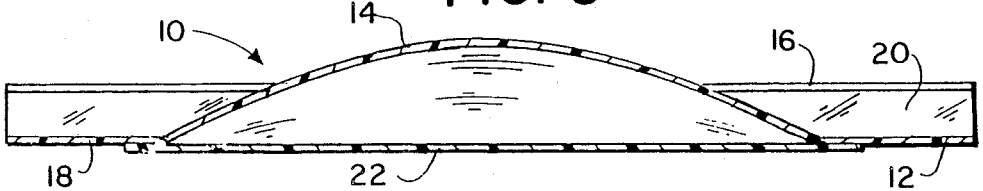
FIG. 3 is a cross-sectional view of the skylight of FIG. 1 through the plane 3—3.
Figure 2:
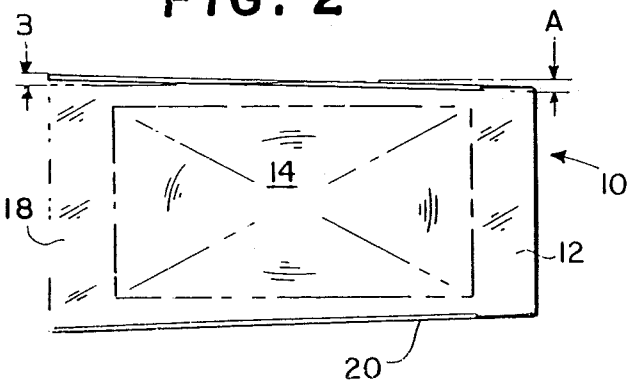
FIG. 2 is a top view of the skylight of FIG. 1.

In FIG. 2, a design feature of skylight element 10 is indicated. As shown in somewhat exaggerated form, the seam portions 20 are not parallel but taper slightly longitudinally. This produces a spacing A at one end of skylight 10 and a spacing B at the opposite end with respect to parallel edges of metal roof panels. This deviation from a straight line may be on the order of ⅛ inch. This permits the narrow end 12 to be inserted between the upstanding seams of an abutting metal standing seam panel and the end of the abutting steel panel at the opposite end will slide inside of wide end 18. As will now be recognized, dimensions A and B need only be approximately the thickness of the sheet metal of the metal roof panels. A cross section of the skylight 10 of FIG. 1 through the plane 3—3 is shown in FIG. 3 and a section through plane 4—4 is seen in FIG. 4. Although a single dome skylight 10 may be utilized, it is preferable to add a rectangular plastic sheet 22 bonded to the edges of dome 14 as will be noted. Plastic sheet 22 serves two purposes: it adds additional strength to the dome; and it provides a dead air space for insulation purposes.

Figure 5:
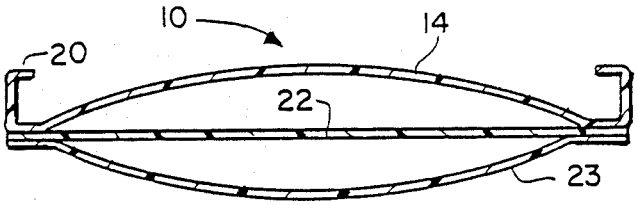
FIG. 5 is a cross-sectional view of a standing seam skylight having triple domes.

Another advantageous construction is shown in the cross-sectional view of a double air space skylight of FIG. 5. The skylight in accordance with FIGS. 3 and 4 has an inverted plastic dome 23 bonded to the edges of plastic sheet 22 thus forming two dead air spaces for additional insulation.

Figure 6:
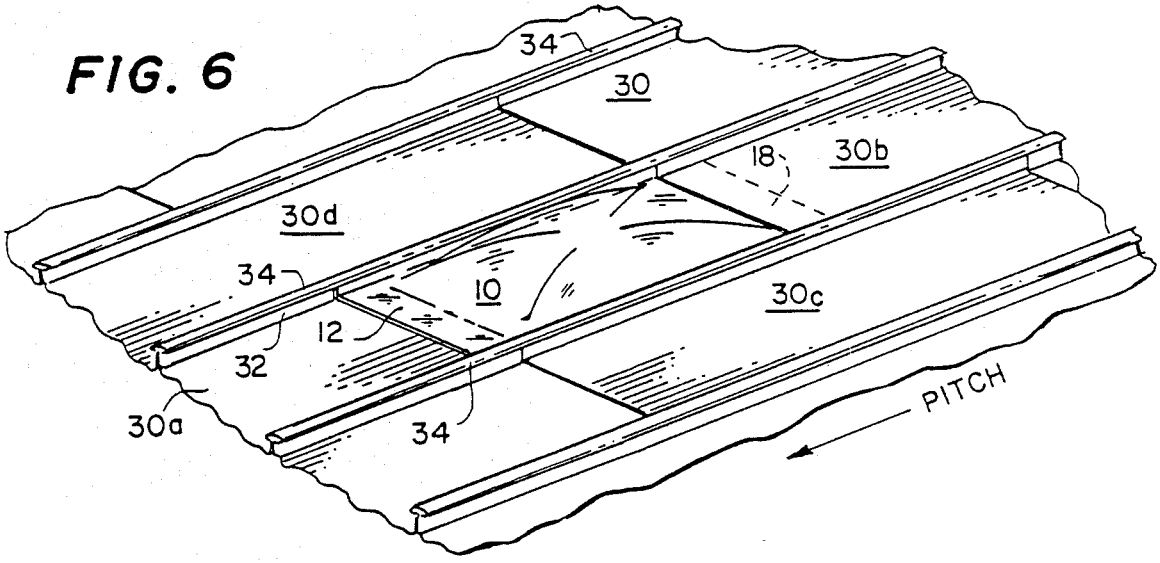
FIG. 6 shows a fragmentary perspective view of a metal roof system having a skylight in accordance with the invention installed therein.
Figure 7:
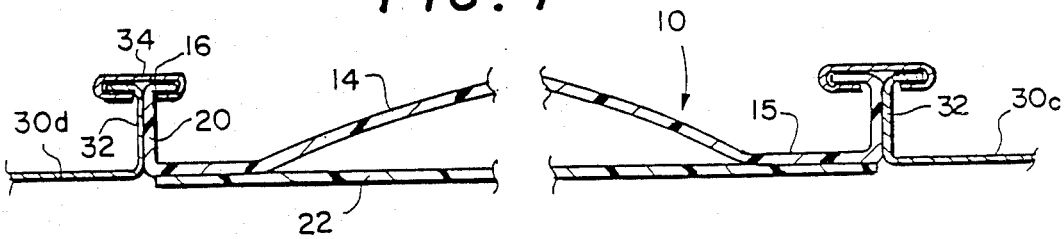
FIG. 7 is a cross-sectional view of the skylight of FIG. 1 in cross section showing the manner of joining to two adjacent metal panels.

In FIG. 6, a skylight 10 in accordance with the invention has been installed between metal roof panels 30*a* and 30*b* and adjacent standing seam metal roof panels 30*c* and 30*d*. As best noted in the cross sectional view through skylight 10 and roof panels 30*c* and 30*d* of FIG. 7, batten strip 34 is crimped around the skylight standing seam 20 and metal roof panel standing seam 32. Sealant may be applied between the seams 20 and 32 prior to installation. End 12 of skylight 10 has been inserted between standing seam 32 of roof panel 30A at the lower end while, at the upper end 18, the lower end of panel 30B has been inserted between standing seams 20. Sealant is placed across the entire length of the flat seam formed at both the upper and lower edges. The installation is made such that the pitch of the roof is as shown by the arrow.

As may be recognized, skylight 10 can be the full width of a metal roof panel 30 and may be installed at any desired location in the roof. Similarly, the length of skylight 10 may be selected in accordance with the amount of exposure desired.

Figure 8:
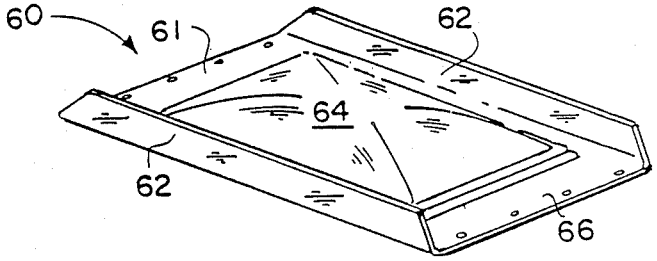
FIG. 8 is a perspective view of a skylight in accordance with the invention for use on shingled roofs and for forming clusters of skylights.

An embodiment of the invention which is suitable for use in shingled roofs, either during new construction or in modification of existing roofs, is shown in FIG. 8. Skylight 60 is formed from sheet plastic having a dome 64 and upper and lower edges 61 and 66 respectively. The longitudinal edges are bent up at 90 to form straight standing seams 62. As will be explained hereinafter, it may be desirable to cut the corners of seams 62 at an angle as shown.

Figure 9:
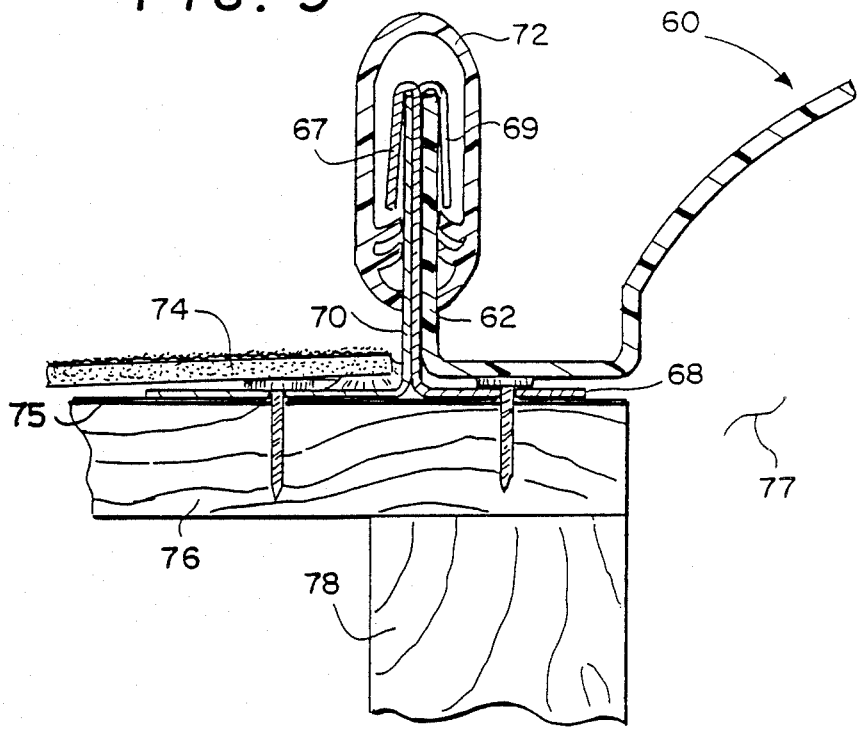
FIG. 9 is a partial cross-sectional view of a skylight of FIG. 6 installing on a shingled roof.
Figure 13:
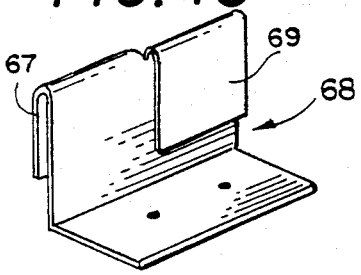
FIG. 13 is a perspective view of an anchor clip utilized with the standing edge seams of the skylight of FIG. 8 and of the skylights of the sunroof of FIG. 12.

The method of installation of skylight 60 in a shingled roof is shown in the partial cross sectional view of FIG. 9. Here, a rafter or truss element 78 is shown supporting roof sheathing 76. A space indicated at 77 is left which is open to the interior of the building over which the skylight dome will be installed. The skylight is held in place by a plurality of anchor clips 68 shown in more detail in the perspective view of FIG. 13. Anchor clips are nailed to sheathing 76 and spaced along the skylight seams 62. As may be noted, one clip end 69 is folded over standing seam 62. A plurality of step flashing elements 70 having vertical portions of the same height as standing seam 62 is abutted to standing seam 62 and anchor clips 68. One clip end 67 in each anchor clip 68 is folded over an adjacent step flashing 70. A horizontal portion of step flashing 70 is nailed to roof sheathing 76 beneath roofing 74 and over roofing felt 75. As is well known in the art, the step flashings 70 are suitably overlapped and installed with shingles 74 to prevent water leakage. After installation of the skylight 60, anchor clips 68 and step flashing 70, the standing seam is covered with a seam cover or batten 72. This batten may be formed of sheet metal, crimped over the standing seam and filled with sealant to insure a watertight seam. However, a snap-on seam having an extruded vinyl weather seal such as is available from Berridge Manufacturing Company may be used. This snap-on seam device presents an attractive appearance and forms a weathertight seal, although sealant may also be used.

Figure 10:
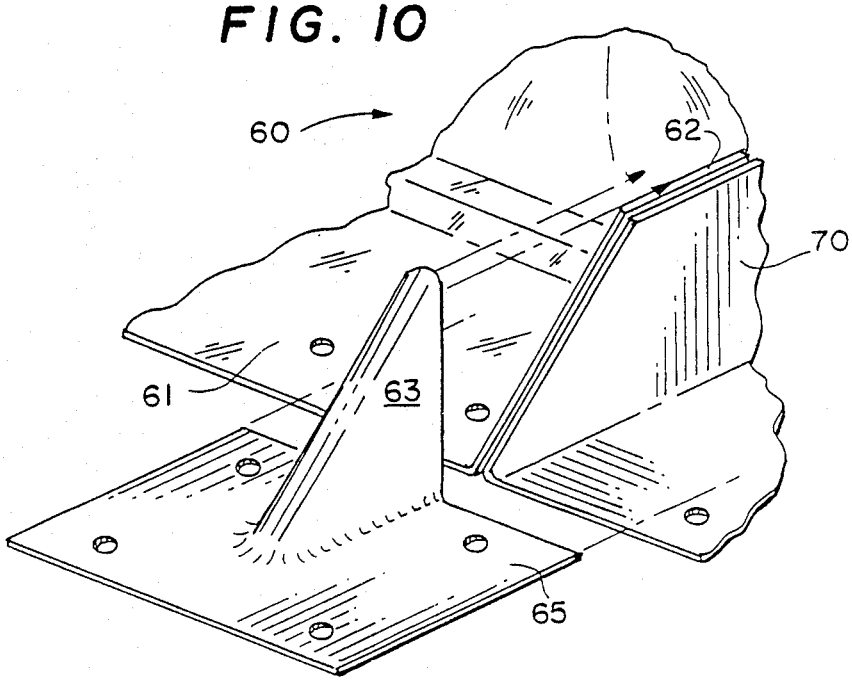
FIG. 10 is a perspective view of a shroud showing the manner of installing on the skylight of FIG. 9.

At the upper and lower ends of skylight 60, skylight ends 66 and 61 are nailed to the roof sheathing in conventional fashion with sealant installed between the roofing felt and the skylight ends. To prevent leakage at the ends of the standing seams, a shroud 65 seen in FIG. 10 is provided. Shroud 65 may be formed from sheet metal, plastic or the like. An angular recess 63 is formed which matches the ends of skylight standing seams 62. The step flashing 70 and standing seam 62 are trimmed to match this angle and shroud 65 is filled with sealant and placed over step flashing 70 and standing seam 62. It is then nailed to the roof sheathing. Thereafter, snap-on seam cover 72 is installed on seams 62 and step flashing 70, producing a watertight seam. Shingles are laid overlapping end 61 and shroud 65.

As will now be recognized, this embodiment of the invention permits a low cost and watertight installation of a skylight in either an existing roof or in new construction without the time, labor and materials required to construct a curb in the roof opening for a curb type skylight. It also eliminates the problems heretofore found with self flashing skylights due to separation and cracking of sealant after exposure to the weather and provides a desirable low profile skylight.

In a third embodiment of the invention, the standing seam skylight illustrated in FIG. 8 may be modified slightly to permit clustering of units to form a sunroof or multiple skylights in a shingled roof. A cluster skylight may have the width of lower end 66 slightly less than the width of upper end 61 so that two skylights may be overlapped vertically, similar to the construction of skylight 20 of FIGS. 2 and 6. Thus, such modified skylights may be clustered vertically and side by side.

Figure 11:
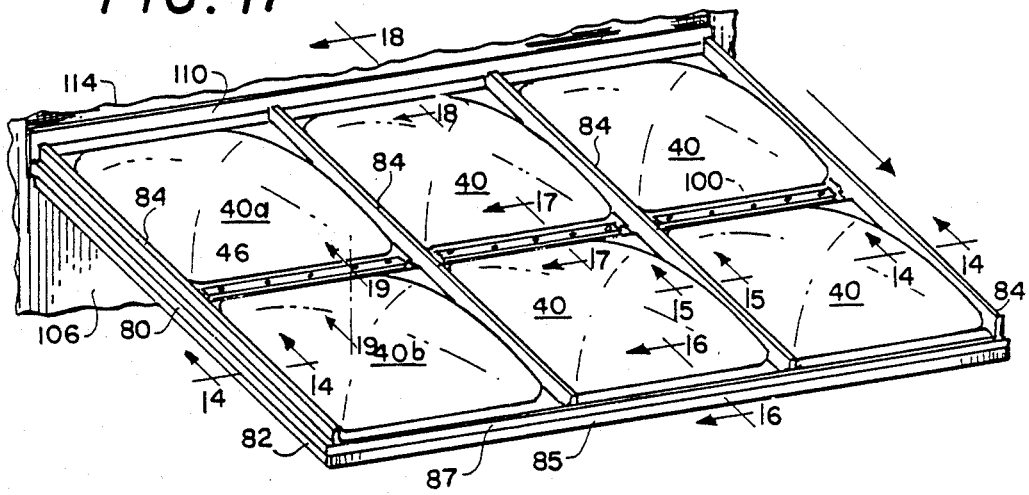
FIG. 11 is a typical sunroof shown in perspective view using the skylights similar to those of FIG. 8.
Figure 12:
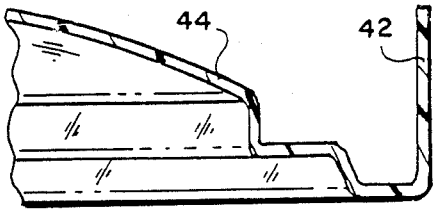
FIG. 12 is a partial lateral cross-sectional view of one of the skylights of FIG. 11 showing a standing seam thereof.

Turning to FIG. 11, a sunroof is shown formed by six such modified skylights 40 having three sets of two vertically clustered units disposed side by side. The sunroof of FIG. 11 has a pitch as indicated in the direction of the arrow. FIG. 12 shows a partial cross section through a skylight 40 of FIG. 11 illustrating the standing seam edge 42.

The sunroof as shown in FIG. 11 formed with multiple skylights 40 is mounted on a rafter and purlin system. A side perimeter rafter 82 is shown with the system having a similar rafter along the opposite side, a front perimeter rafter 85, and a pair of interior rafters 83, not seen in this view. Purlins 100, also not shown, run between the rafters 82 and 83. Details of the joints between the skylights 40 and the manner of connecting the skylights 40 to the rafters and purlins are shown in FIGS. 14 through 19.

Figure 14:
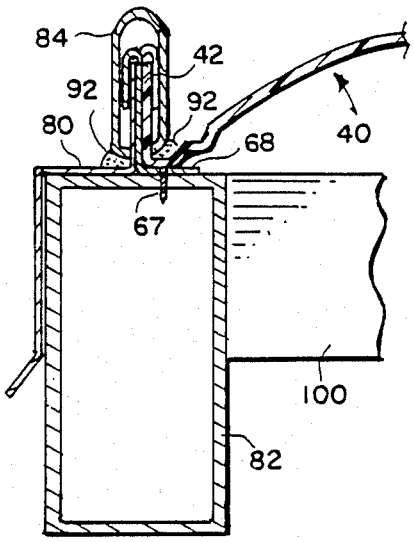
FIG. 14 shows a cross-sectional view of a perimeter rafter of the sunroof of FIG. 11 showing in partial view the installation of the standing seam edge of the skylight thereof.
Figure 15:
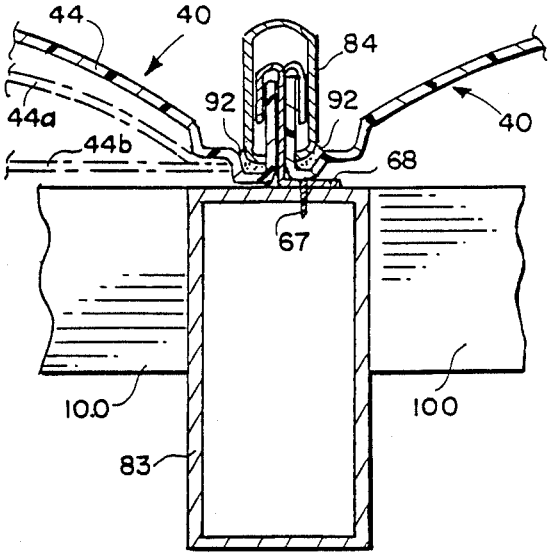
FIG. 15 is a cross-sectional view of an interior rafter of the sunroof of FIG. 11 showing partially two abutting longitudinal standing seams of the skylight of FIG. 8.
Figure 16:
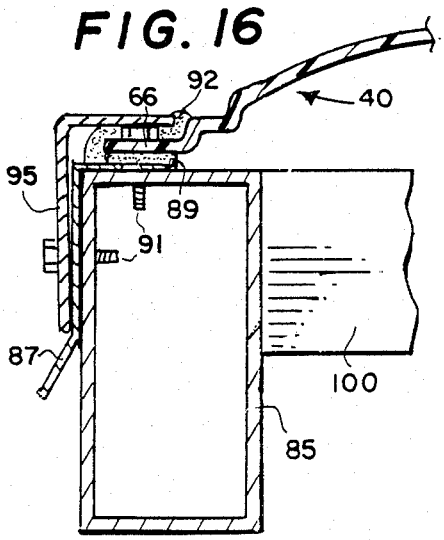
FIG. 16 is a cross-sectional view of the front perimeter rafter of the sunroof of FIG. 11 showing the manner of attaching the skylight end thereto.

FIG. 15 shows a cross-section through plane 14—14 of FIG. 11. Although the rafters and purlins may be of wood or other material, it is preferred to use rectangular extruded aluminum tubing. In FIG. 14, a side perimeter rafter 82 is seen having an anchor clip 68 fastened to rafter 82 by screws 67. Flashing 80 is butted with side seam 42 of skylight 40 and the upper clip ends of anchor clip 68 are bent over the skylight standing seam and the flashing 80 to hold these elements securely in place. Sealant is applied to this seam prior to assembly. A seam cover 84 is then placed over the seam and sealant 92 installed to insure against leakage. Seam covers 84 may also be filled with sealant. As will be understood, anchor clip 68 may be installed every foot or so along the seam.

In FIG. 15, the standing seam between two adjacent skylights is shown in cross-section through plane 15—15 of FIG. 11. An interior rafter 83 has anchor clips 68 fastened to it by screws 67. Anchor clips 68 are bent over standing seams 42 of the adjacent skylights and a seam cover 84 installed with sealant 92.

Figure 17:
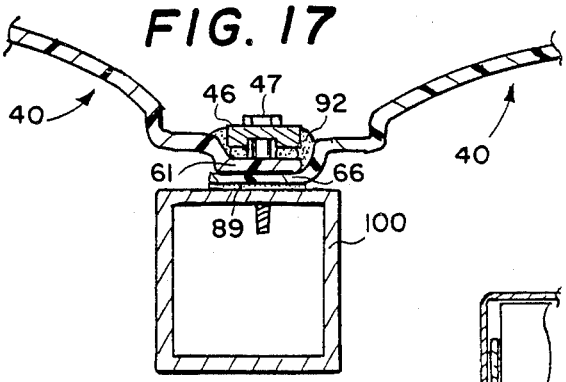
FIG. 17 is a cross-sectional view through a purlin showing the manner of coupling the lateral ends of two of the skylights of FIG. 11 and attaching to the purlin.
Figure 18:
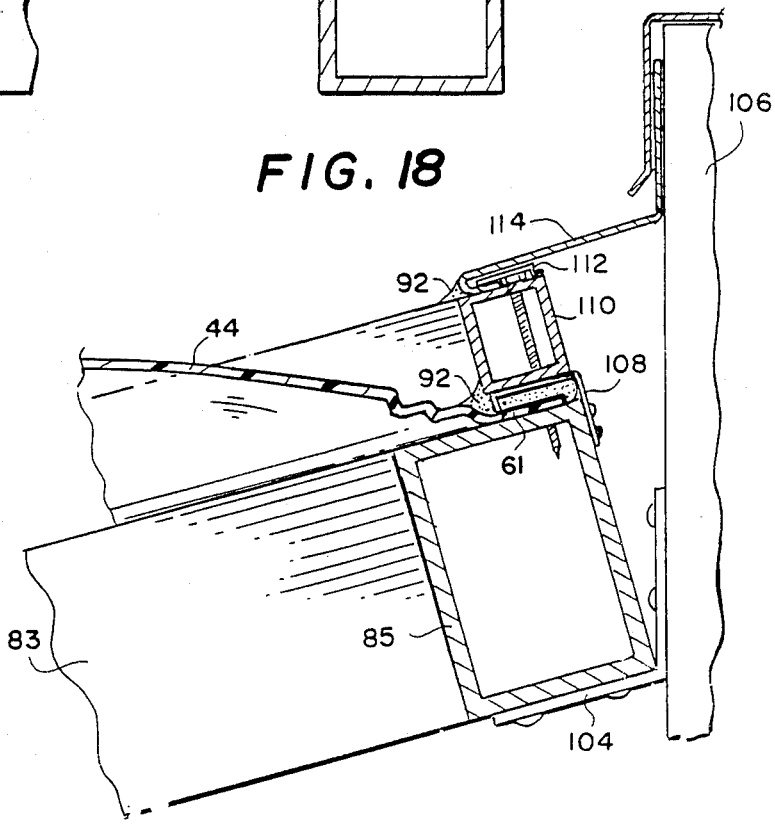
FIG. 18 is a cross-sectional view of the rear perimeter rafter of the sunroof of FIG. 11 showing the attachment to a building.

Along the front perimeter rafter 85, the lower edge 66 of skylight 40 is attached thereto as shown in the cross-sectional view of FIG. 17 through plane 16—16 of FIG. 11. Front rafter flashing 87 runs the length of rafter 85 and is attached thereto by screws 91. Skylight end 66 is attached to rafter 85 by means of adhesive sealant tape 89 and screws 93. Sealant 92 is provided along end 66 to insure a leakproof joint and cover flashing 95 is installed along the joint. The manner in which the upper and lower ends of two skylights 40 are joined is indicated in FIG. 17 through plane 17—17 of FIG. 11. Upper end 66 of the lower skylight is overlapped with lower end 61 of the upper skylight. A cap bar 46 is mounted over and along the joint formed between ends 66 and 61 with screws 47 used to secure the joint to the purlin 100. Sealant tape 89 is applied between end 66 and purlin 100 and between cap bar 46 and end 61. Sealant 92 may also be added as required to prevent leakage. A typical joint between the sunroof and a building 106 is shown in cross-sectional view in FIG. 18 along plane 18—18 of FIG. 11. The rafter assembly 83 and 85 is attached to a hanger bracket 104 which is fastened to wall 106. The upper end 66 of skylight 44 is held against rear perimeter rafter 85 by clips 108. A closure channel 110 is fastened by suitable screws to rafter 85. A plurality of Z-clips 112 along the top of channel 110 is used to hold flashing 114 in place. The assembly is sealed with sealant 92.

Figure 19:
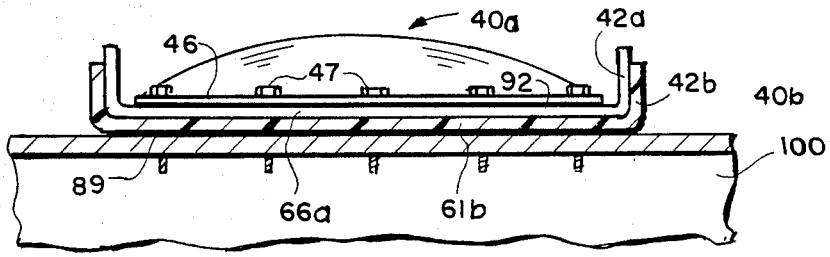
FIG. 19 is a partial cross-sectional view of the lateral joint between skylights **40*a* and 40*b* of FIG. 11**.

FIG. 19 shows a cross-sectional view along the vertical plane 19—19 of FIG. 11 in which lower end **66*a* of skylight 40*a* overlaps upper end 61*b* of skylight 40*b* and is secured to purlin 100 by cap bar 46 and screws 47. Sealant 92 and sealant tape 89** ensure a leakproof joint.

For use in a sunroof as in FIG. 11, standing seam edges 42 of skylights 40 may have their upper and lower ends cut essentially squarely. When a cluster is to be installed in a shingle roof, the ends of seams 42 adjacent the shingled areas may be cut at an angle to accept a shroud 65 as previously described.

It will be understood that in the figures, the thicknesses of the materials and the spacings therebetween are somewhat exaggerated for clarity. In actual use, the joints are formed to overlap tightly with a minimum of space between the materials forming the joints. Prior to joining the edges, sealant is applied to fill any voids.

Although specific implementations and configurations of the skylights of the invention have been disclosed and described herein, the invention is not to be considered limited to such examples. Various modifications to the exemplary disclosures will be obvious to those of skill in the art and are considered to fall within the spirit and scope of the invention.

We claim:

1. A skylight molded from sheet plastic for installation in a roof formed from a plurality of metal roof panels, each of said metal panels having a pair of upstanding edges with the top edges thereof folded inwardly with means for joining such edges with adjacent abutting upstanding edges comprising:

an essentially rectangular first sheet of plastic having a pair of longitudinal edges thereof folded upwardly to form an angle with said sheet of plastic, each of said upwardly folded edges having a top edge thereof folded inwardly to match said upstanding seam edges of said metal roof panels in which said folded up edges are spaced apart a distance slightly less than the spacing of said upstanding seam edges of said metal standing seam roof panels at one end of said sheet of plastic and spaced apart a distance slightly greater than the spacing of said standing seam edges of said metal standing seam roof panels at the other end thereof, said first sheet of plastic having a pair of lateral edges thereof forming a first lateral self flashing flange at said one end of said sheet of plastic for overlapping a first of said metal roof panels, and a second lateral self flange at said other end of said sheet of plastic for underlapping a second of said metal roof panels; and a dome formed in and projecting upward from said sheet of plastic.

2. A skylight as recited in claim 1 which further comprises a sheet of plastic disposed below said dome and bonded to said first sheet of plastic to form a first insulating air space between said second sheet of plastic and said dome.

3. A skylight as recited in claim 2 which further comprises a third sheet of plastic having a downwardly projecting dome formed therein, said third sheet of plastic disposed below and bonded to said second sheet of plastic to form a second insulating air space between said third sheet of plastic and said second sheet of plastic.

4. A sheet plastic dome skylight installation for a pitched shingled roof having roof sheathing with a rectangular opening therethrough, said opening having a pair of sloping edges, an upper horizontal edge, and a lower horizontal edge comprising:

a) a rectangular skylight formed from a rectangular sheet of plastic having i) a first pair of parallel edges thereof folded upward to form an angle with said sheet of plastic thereby producing a pair of standing seam edges, ii) a pair of parallel flat flanges formed along a second pair of parallel edges of said rectangular sheet of plastic, iii) a dome portion in the central portion of said sheet of plastic, and iv) said skylight being disposed over and covering said opening with said standing seam edges disposed along said pair of sloping edges of said roof opening and attached to said roof sheathing and a first one of said flat flanges disposed along said upper horizontal edge of said opening and attached to said roof sheathing and a second one of said flat flanges disposed along said lower horizontal edge of said opening and attached to said roof sheathing over a row of said roof shingles;

b) means for anchoring said standing seam edges of said skylight along the sloping edges of said roof sheathing adjacent said opening;

c) step flashing means attached to said roof sheathing and having portions thereof abutting with each of said standing seam edges of said skylight, said anchoring means attached to standing seams formed by said step flashing means and said skylight standing seam edges; and d) means for sealing each of said standing seams.

5. The skylight installation as recited in claim 4 in which said anchoring means includes a plurality of anchor clips attached to said roof sheathing.

6. The skylight installation as recited in claim 5 in which said step flashing means includes a plurality of overlapping step flashings, each having a horizontal portion thereof attached to said sheathing and a vertical portion thereof abutting with said standing seam edges of said skylight.

7. The skylight installation as recited in claim 6 which further comprises:

a vertical row of overlapping roof shingles disposed along each of said standing seams and covering said horizontal portions of said step flashings; and a horizontal row of overlapping roof shingles disposed along and covering said first one of said flat flanges of said skylight.

8. The skylight as recited in claim 7 in which the corner of an upper end of each of said standing seams formed by said standing seam edges and said step flashing flanges is cut off at an angle and which further comprises a shroud formed to match said cutoff ends, said shroud disposed over said cutoff ends and attached to said roof sheathing prior to disposition of said roof shingles over said flat flange.

9. The skylight installation as recited in claim 4 in which said means for sealing includes a batten disposed over said standing seams.

10. The skylight installations as recited in claim 9 in which said batten is filled with a sealing compound.

* * * * *